US009016527B2

(12) United States Patent
Faneca Llesera

(10) Patent No.: US 9,016,527 B2
(45) Date of Patent: Apr. 28, 2015

(54) PRECOMPRESSION PUMP MECHANISMS

(75) Inventor: Oscar Faneca Llesera, Barcelona (ES)

(73) Assignee: MeadWestvaco Calmar, Inc., Richmond, VA (US)

( * ) Notice: Subject to any disclaimer, the term of this patent is extended or adjusted under 35 U.S.C. 154(b) by 22 days.

(21) Appl. No.: 13/880,392

(22) PCT Filed: Oct. 20, 2011

(86) PCT No.: PCT/US2011/056992

§ 371 (c)(1), (2), (4) Date: Apr. 19, 2013

(87) PCT Pub. No.: WO2012/054670

PCT Pub. Date: Apr. 26, 2012

(65) Prior Publication Data

US 2013/0230423 A1 Sep. 5, 2013

Related U.S. Application Data

(60) Provisional application No. 61/405,011, filed on Oct. 20, 2010.

(51) Int. Cl.

| | |
|---|---|
| ***B65D 88/54*** | (2006.01) |
| ***F04B 19/22*** | (2006.01) |
| ***B05B 11/00*** | (2006.01) |

(52) U.S. Cl.

CPC ..... *F04B 19/22* (2013.01); *B05B 11/0016* (2013.01); *B05B 11/3026* (2013.01); *B05B 11/3047* (2013.01); *B05B 11/3049* (2013.01); *B05B 11/3074* (2013.01); *B05B 11/3077* (2013.01)

(58) Field of Classification Search

CPC ..... B65D 47/2056; B05B 11/3001
USPC ..... 222/321.1–321.9
See application file for complete search history.

(56) References Cited

U.S. PATENT DOCUMENTS

| | | | | |
|---|---|---|---|---|
| 3,774,849 | A * | 11/1973 | Boris | 239/338 |
| 5,100,027 | A * | 3/1992 | Gueret | 222/105 |
| 6,186,369 | B1 * | 2/2001 | Rosenthal | 222/321.7 |
| 6,196,424 | B1 * | 3/2001 | Bougamont et al. | 222/321.9 |
| 6,237,814 | B1 * | 5/2001 | Blyler et al. | 222/189.09 |
| 6,371,337 | B2 * | 4/2002 | Garcia et al. | 222/385 |
| 6,736,293 | B2 * | 5/2004 | Greiner-Perth | 222/321.9 |
| 7,246,723 | B2 * | 7/2007 | Santagiuliana | 222/209 |
| 7,410,079 | B2 * | 8/2008 | Kuwahara et al. | 222/321.2 |
| 7,735,693 | B2 * | 6/2010 | Pares Montaner et al. | 222/321.2 |
| 7,954,674 | B2 * | 6/2011 | Roy et al. | 222/321.6 |
| 8,528,792 | B2 * | 9/2013 | Ophardt et al. | 222/321.6 |
| 2004/0069811 | A1 * | 4/2004 | Perignon et al. | 222/321.7 |
| 2008/0210713 | A1 * | 9/2008 | Langlois et al. | 222/321.9 |
| 2009/0283548 | A1 * | 11/2009 | Hummel | 222/321.7 |
| 2012/0325862 | A1 * | 12/2012 | Kuwahara et al. | 222/321.9 |

OTHER PUBLICATIONS

Search Report for PCT/US2011/056992 dated Feb. 28, 2012.

* cited by examiner

*Primary Examiner* — Kevin P Shaver
*Assistant Examiner* — Michael J Melaragno
(74) *Attorney, Agent, or Firm* — MeadWestvaco Intellectual Property Group

(57) ABSTRACT

Pump engines and pump assemblies include a metal free fluid or product flow path and a precompression feature integrated into a piston incorporated in the pump engine.

8 Claims, 18 Drawing Sheets

PRECOMPRESSION PUMP MECHANISMS

CROSS-REFERENCE TO RELATED APPLICATIONS

This application claims the benefit of U.S. Provisional Application No. 61/405,011, entitled "PUMP MECHANISMS AND METHODS OF MAKING THE SAME," filed 20 Oct. 2010, and incorporates the same herein by reference in its entirety.

BACKGROUND OF THE INVENTION

1. Field of the Invention

The present invention relates to pumps, pump devices, and methods of making the same.

2. State of the Art

Pump systems and pump devices are well known and are used for the delivery of a variety of fluids or pasty products. In the personal and beauty care markets, pumps and pump devices are often used to deliver a fluid—such as lotions, soaps, make-up, skin treatment formulas, and other products—to a user. Many of the pumps used include metal and plastic parts. For example, a pump may include a metal valve part and a metal spring and the remaining components of the pump may be made of molded plastic or resin materials. However, many fluids or products which are dispensed by pumps are reactive with metal. Therefore, it is desirable to have a fluid path that is free of metal. Also, as sustainability of products becomes more important to certain markets, there is the desire to have pumps that may be recycled. In many instances, pumps having both metal and plastic components cannot be recycled using conventional recycling processes due to the mixed material components. Therefore, it is desirable to construct a pump out of common materials that may be easily recycled without requiring the disassembly of the pump. In addition, all plastic pumps are desirable. However, it is also desirable that the functionality of an all plastic pump be similar to or better than that of mixed component pumps.

BRIEF SUMMARY OF THE INVENTION

Various embodiments of the invention include pump engines made entirely from plastic components.

According to certain embodiments of the invention, a pump engine may include an accumulator, a valve element within an interior portion of the accumulator, a piston sub-assembly partially seated in a portion of the accumulator and a spring element for facilitating actuation of the piston sub-assembly and return of the piston following actuation thereof. A piston sub-assembly may include a stem having an interior space, a piston seated in at least a portion of the interior space of the stem, and a plug seated in a portion of an interior space of the piston and in a portion of the interior space of the stem. In various embodiments of the invention, the accumulator, piston sub-assembly, and spring element may all be made of a plastic or resin material.

In some embodiments of the invention, a piston may include walls configured to provide a precompression feature to the pump engine. For example, in some embodiments, a piston wall may include both a sloped portion and a vertical portion configured to flex when a certain force is applied to the wall. Flexion of the piston wall may unseat the plug from an interior wall of the piston and allow product to flow past the plug and through the stem. In other embodiments, a piston wall may be configured as a straight wall which will flex as force is applied thereto. The flexion may provide a precompressive force on the product prior to an unseating of the plug and piston.

According to some embodiments of the invention, an accumulator may include one or more steps in a wall of the accumulator. The one or more steps may serve to narrow the circumference of the accumulator over the length of piston travel during actuation of a piston. The decrease in circumference may increase the contact forces or compression forces between the piston and the accumulator during actuation, thus ensuring a tight seal. In addition, the release of such forces as the piston travels over a step back to a rest position may help to improve the life span or life cycle of the piston.

According to some embodiments of the invention, a spring element may be made of plastic and may include one or more spring slots and one or more spring arms which may bend or flex to allow the spring element to collapse on itself during actuation of a pump engine and to expand back to its original shape upon de-actuation.

Other embodiments of the invention may include components designed and configured to provide precompression features to a pump. In still other embodiments, the materials used to make the components may be recyclable materials, allowing the pump engine to be recycled. In still other embodiments of the invention, a pump engine made of plastic components may be assembled with a container and a pump head to produce a pump assembly which may be used to pump a product from the container for use by a user.

BRIEF DESCRIPTION OF THE DRAWINGS

While the specification concludes with claims particularly pointing out and distinctly claiming particular embodiments of the present invention, various embodiments of the invention can be more readily understood and appreciated by one of ordinary skill in the art from the following descriptions of various embodiments of the invention when read in conjunction with the accompanying drawings in which:

DETAILED DESCRIPTION OF THE INVENTION

Figure 1:
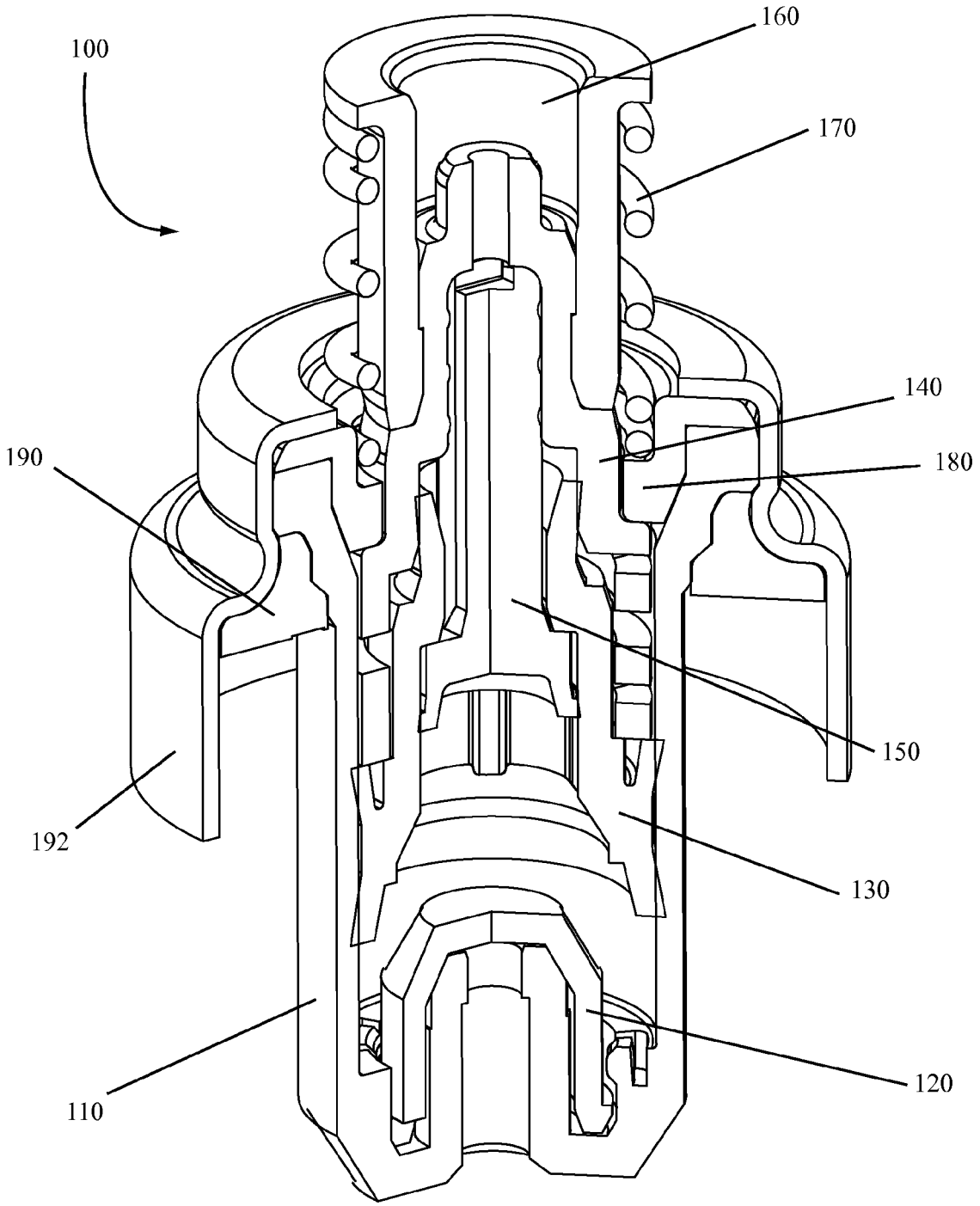
FIG. 1 illustrates a cut-away view of a pump engine and container attachment system according to various embodiments of the invention.

A pump engine and container attachment system according to certain embodiments of the invention is illustrated in FIG. 1. As illustrated, a pump engine 100 according to embodiments of the invention may include an accumulator 110, a valve element 120, a piston 130, a stem 140, a pin 150, a retainer 160, a spring 170, and a plug 180. A container attachment 192 with or without a sealing ring 190 may be used to connect the pump engine 100 to a container in a conventional manner.

According to embodiments of the invention, the accumulator 110, valve element 120, piston 130, stem 140, pin 150, retainer 160 and plug 180 may be made of a plastic or resin material. Each of these parts may be molded from a resin or plastic material using conventional methods. In addition, other non-metal materials may be substituted to make such parts.

According to various embodiments of the invention, the spring 170 may be metal. In other embodiments, the spring 170 may be made of a plastic, resin, or other non-metal material.

Figure 2:
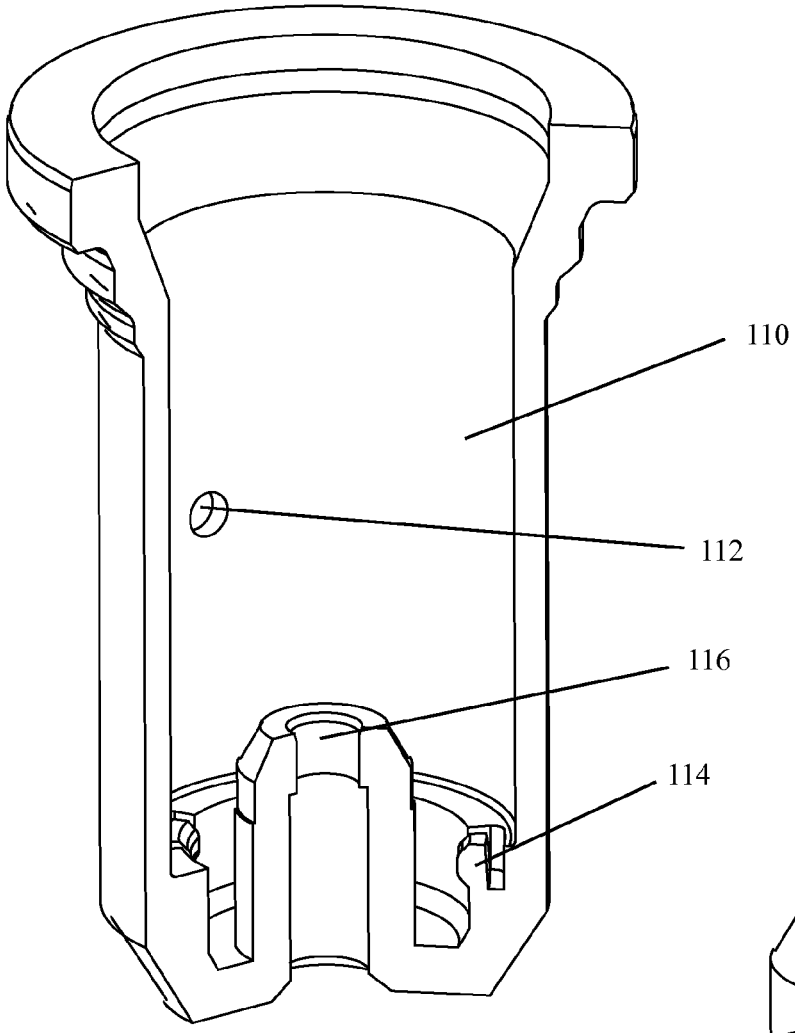
FIG. 2 illustrates a cut-away view of an accumulator for a pump engine according to various embodiments of the invention.
Figure 3:
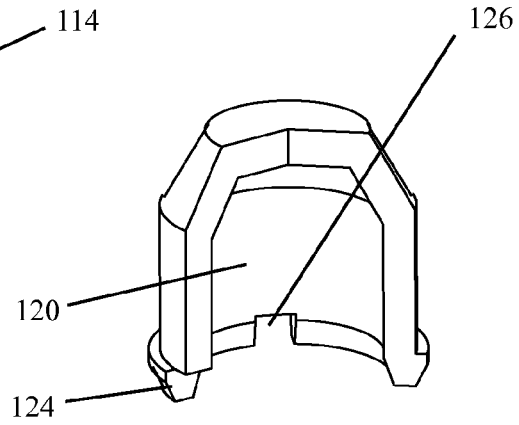
FIG. 3 illustrates a cut-away view of a valve for a pump engine according to various embodiments of the invention.
Figure 4:
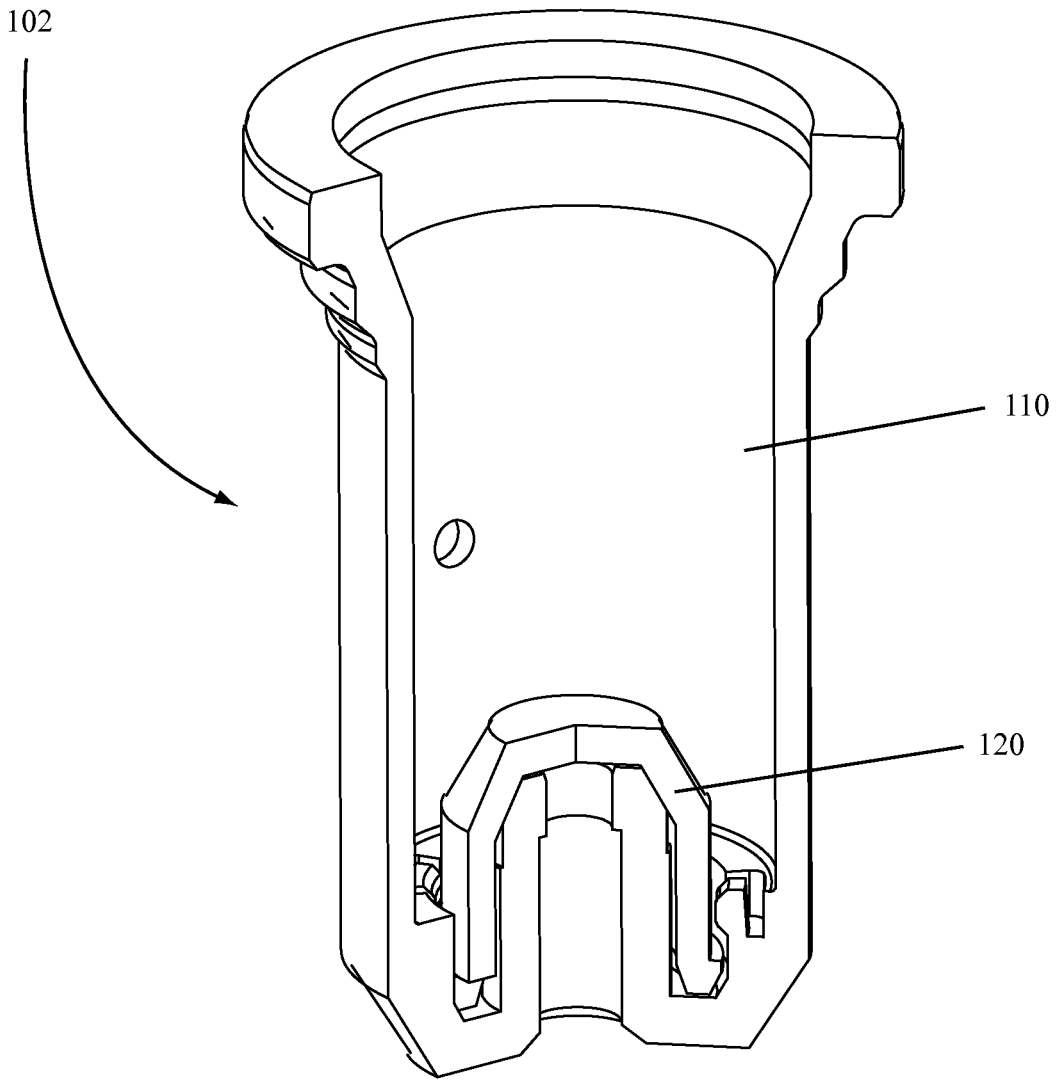
FIG. 4 illustrates a cut-away view of an accumulator and valve sub-assembly according to various embodiments of the invention.

According to various embodiments of the invention, an accumulator 110 and valve element 120 as illustrated in FIGS. 2 and 3 may be combined or assembled into an accumulator and valve sub-assembly 102 as illustrated in FIG. 4. An accumulator 110 may include any combination of one or more vent holes 112, one or more product intake openings 116, and one or more valve snaps 114. The one or more vent holes 112 may provide venting to a container. The one or more product intake openings 116 may work in conjunction with the valve element 120 to allow fluid or product to enter an interior space within the accumulator 110. The one or more valve snaps 114 may be configured to retain a valve element 120 once assembled with the accumulator 110.

A valve element 120 according to various embodiments of the invention may include one or more valve lips 124 and one or more valve element openings 126. The one or more valve lips 124 may be configured to retain the valve element 120 in an assembled position with an accumulator 110 as illustrated in FIG. 4. During assembly, the valve element 120 may be forced or snapped into position with an accumulator 110 such that the one or more valve lips 124 snap over the one or more valve snaps 114, locking the valve element 120 in an assembled position with the accumulator 110 as illustrated in FIG. 4. The one or more valve element openings 126 may allow product flowing through the one or more product intake openings 116 of the accumulator 110 to enter an interior space of the accumulator 110. In some embodiments of the invention, the valve element 120 may rest over the one or more product intake openings 116, preventing product from passing therethrough. Upon an upstroke of the pump engine 100 following actuation, a vacuum force may lift the valve element 120 off of the one or more product intake openings 116 and draw product through a dip tube or from an interior of a container attached to the pump engine 100 as conventionally known. The one or more valve snaps 114 may retain the valve element 120 in the accumulator 110 such that in combination, a valve is formed.

According to other embodiments of the invention, a conventional glass or plastic ball may be used in place of the valve element 120 and the accumulator 110 may be configured to retain the glass or plastic ball in a conventional manner. In other embodiments of the invention, if a metal free fluid or product path is not desired, a metal ball could also be used as a valve element in a conventional manner.

Figure 5:
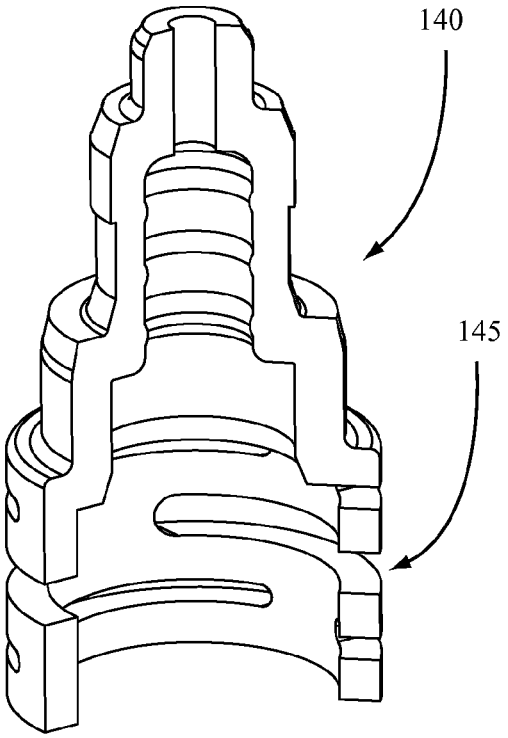
FIG. 5 illustrates a cut-away view of a spring for a pump engine according to various embodiments of the invention.

A stem 140 for a pump engine 100 according to embodiments of the invention is illustrated in FIG. 5. The stem may include a precompression spring 145. The stem 140 and precompression spring 145 may be molded as a single plastic or resin part. According to various embodiments of the invention, the precompression spring 145 may allow the stem 140 to compress by a desired distance to provide a pump engine 100 with a precompression load during actuation of the pump engine 100.

Figure 6:
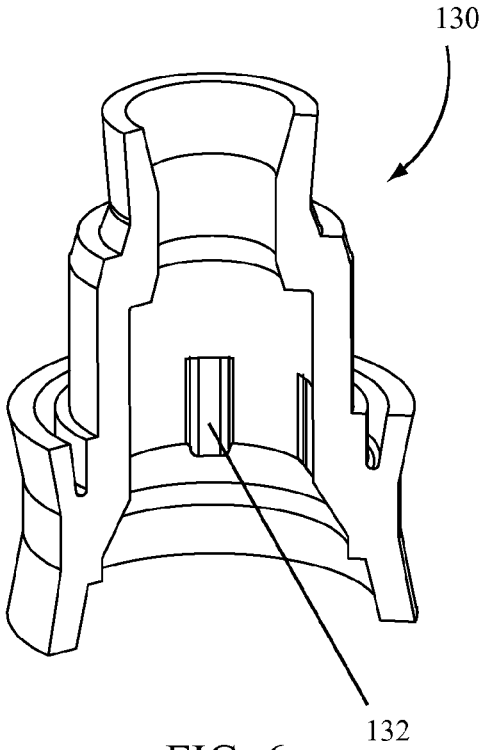
FIG. 6 illustrates a cut-away view of a piston for a pump engine according to various embodiments of the invention.

A piston 130 for a pump engine 100 according to various embodiments of the invention is illustrated in FIG. 6. As illustrated, a piston 130 may include one or more fluid slots 132 configured to allow fluid to pass through the one or more fluid slots 132 and out of the pump engine 100.

Figure 7:
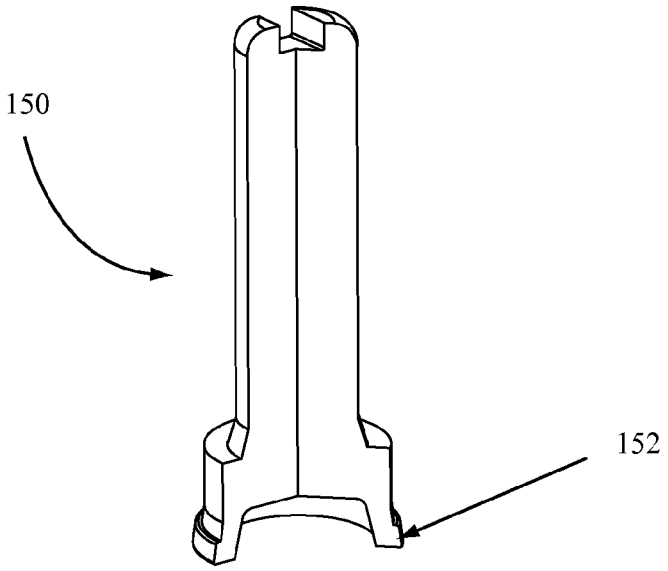
FIG. 7 illustrates a cut-away view of a pin for a pump engine according to various embodiments of the invention.

A pin 150 according to various embodiments of the invention is illustrated in FIG. 7. A pin 150 may include one or more pin lips 152. The one or more pin lips 152 may seal with or mate with an interior portion of the piston 130 when assembled as illustrated in FIG. 8.

Figure 8:
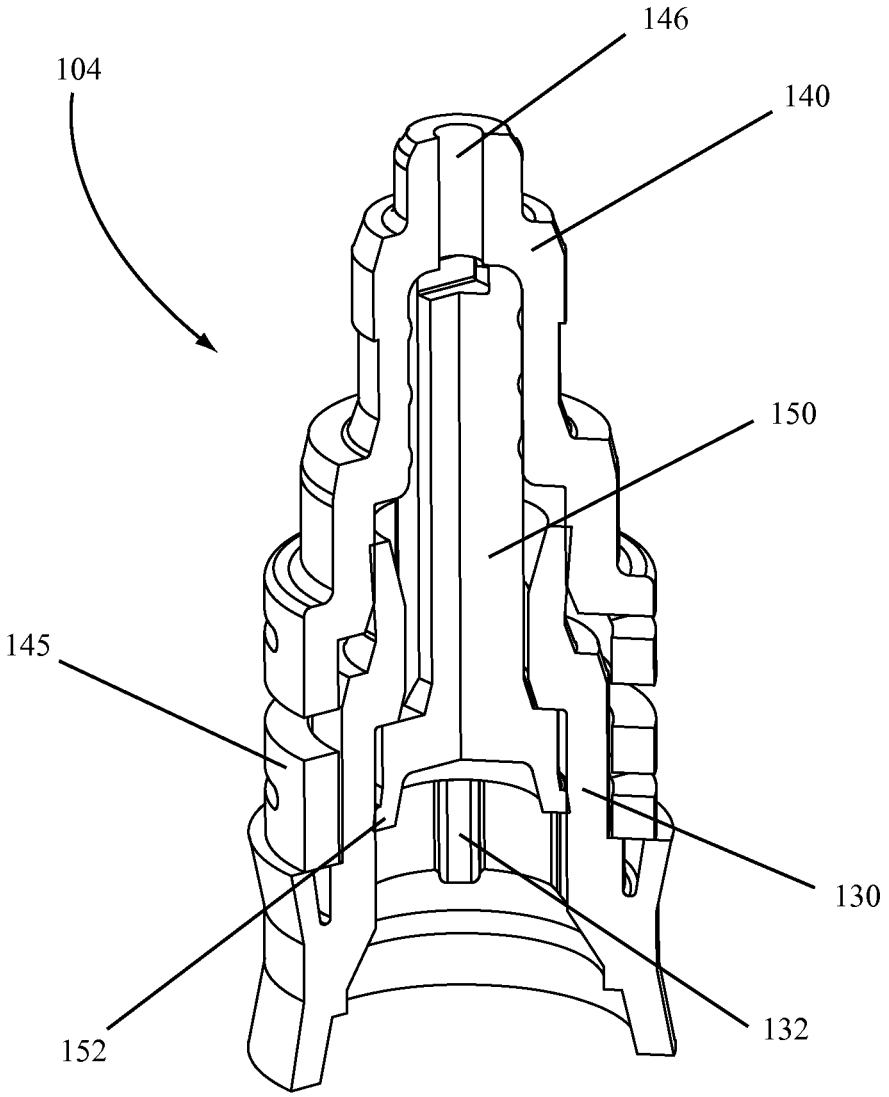
FIG. 8 illustrates a cut-away view of a piston sub-assembly for a pump engine according to various embodiments of the invention.

FIG. 8 illustrates a piston sub-assembly 104 according to various embodiments of the invention. A piston sub-assembly 104 may include an assembly of a stem 140, a piston 130 and a pin 150. The portion of the piston 130 may fit within an interior space of the stem 140 as illustrated. The pin 150 may fit within an interior portion of the piston 130 as illustrated. The one or more pin lips 152 may seal against an interior wall of the piston 130 such that a product within the interior of the piston 130 cannot move past the seal between the piston 130 wall and the one or more pin lips 152. However, as a force, such as an actuation force, is applied to the stem 140, the stem 140 moves the pin 150 within the piston 130 such that the one or more pin lips 152 move past the tops of the one or more fluid slots 132 in the piston 130. This movement opens a fluid or product path from an interior of the piston 130 to an interior of the stem 140. Fluid or product may then flow through a stem product opening 146 in the stem 140. For example, in some embodiments of the invention, the precomprssion spring 145 may be configured to move the pin 150 a set distance before the pin lip 152 passes the top of the one or more fluid slots 132, thereby allowing fluid contained on an interior of the accumulator 110 to pass through the one or more fluid slots 132 and thereby exit the pump engine 100. The precompression spring 145 allows a force to build up on the fluid or product in the interior of the piston 130 which provides a precompression force to the delivery of the product or fluid from the pump engine 100.

Figure 9:
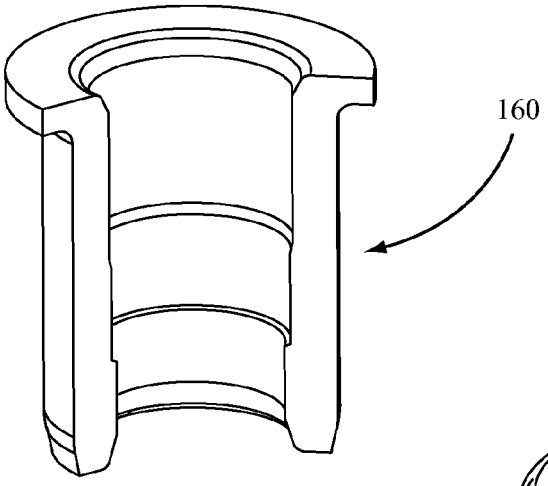
FIG. 9 illustrates a cut-away view of a retainer for a pump engine according to various embodiments of the invention.

A retainer 160 according to various embodiments of the invention is illustrated in FIG. 9. A retainer 160 may be fitted together with a stem 140 as illustrated in the pump engine 100 of FIG. 12. The retainer 160 and stem 140 may be snap-fitted together or attached or fitted together by any other means. The retainer 160 and stem 140 may also be molded as a single component according to some embodiments of the invention.

Figure 11:
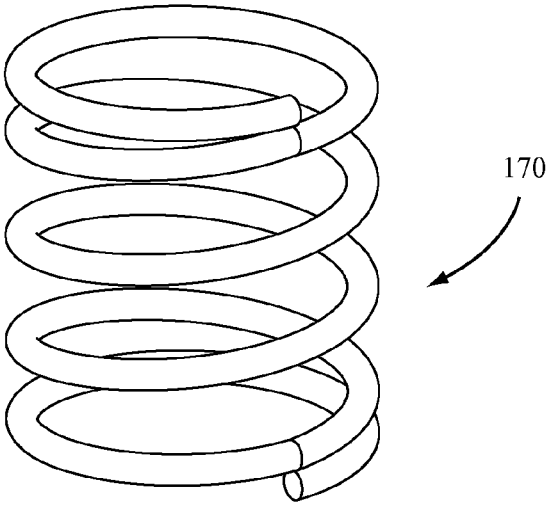
FIG. 11 illustrates a view of a spring for a pump engine according to various embodiments of the invention.
Figure 12:
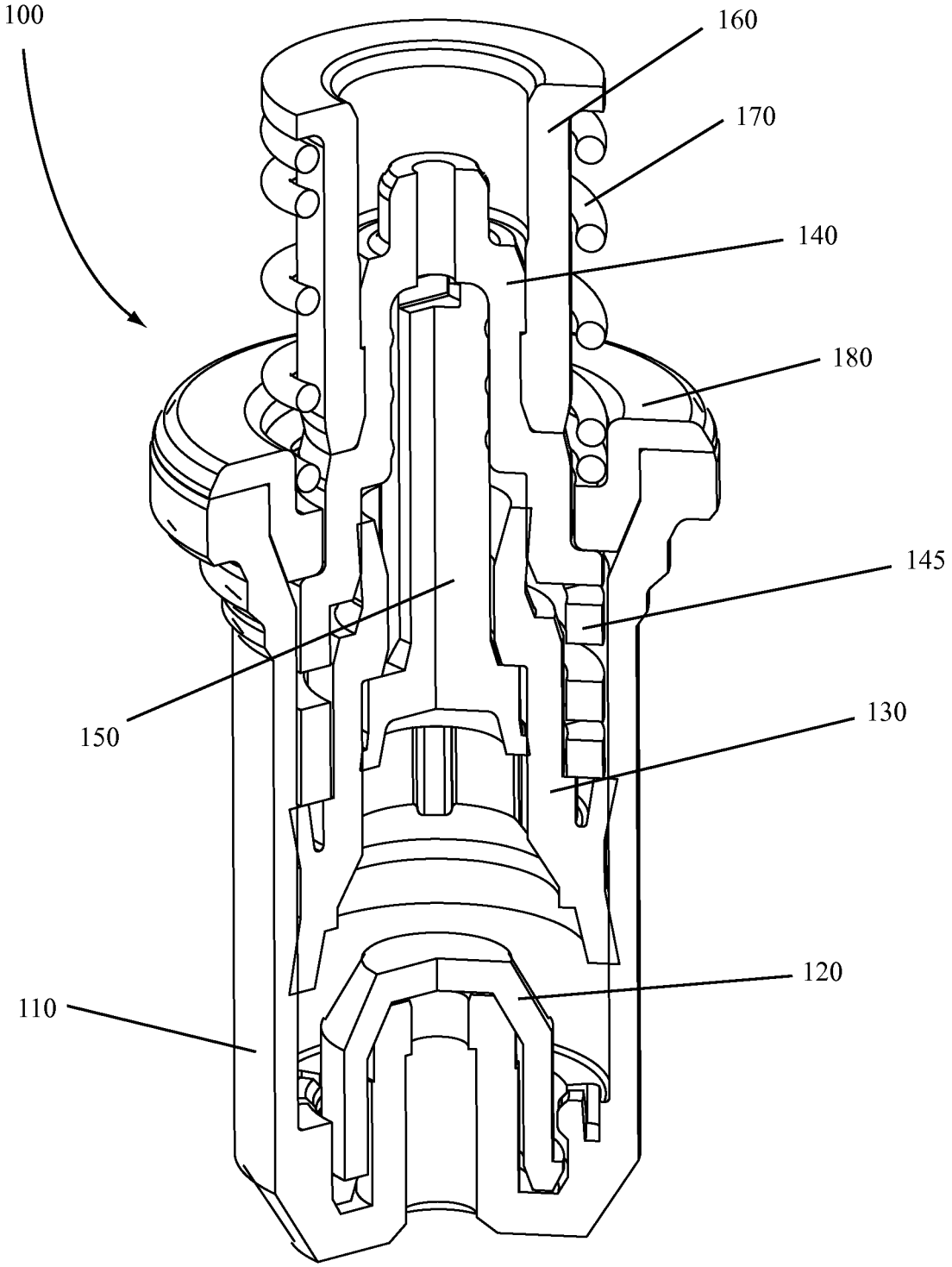
FIG. 12 illustrates a cut-away view of a pump engine according to various embodiments of the invention.

According to certain embodiments of the invention, a retainer 160 may hold a spring 170, such as that illustrated in FIG. 11, in place in a pump engine 100 as illustrated in FIG. 12. The spring 170 may be made of plastic, metal, resin, or other material as desired.

Figure 10:
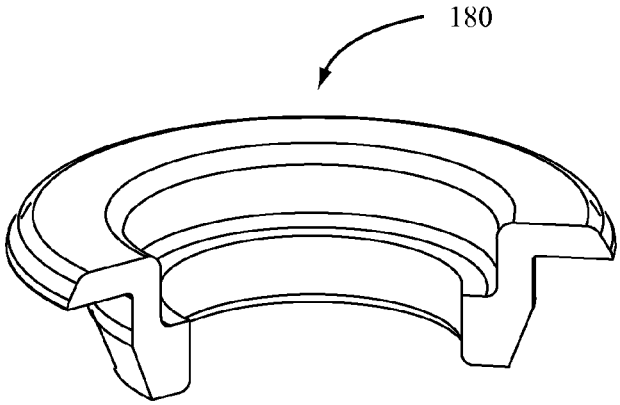
FIG. 10 illustrates a cut-away view of a plug for a pump engine according to various embodiments of the invention.

According to certain embodiments of the invention, a plug 180, such as that illustrated in FIG. 10, may be fitted to a pump engine 100.

According to various embodiments of the invention, a piston sub-assembly 104 may be inserted into an accumulator and valve sub-assembly 102 and retained therein by the insertion of a plug 180 over an open end of the accumulator 110 with a portion of the stem 140 extending through the plug 180 as illustrated in FIG. 12. A spring 170 may be positioned over the plug 180 and around the stem 140. A retainer 160 may be snap-fitted or otherwise connected to the stem 140 to retain the spring 170 between the retainer 160 and the plug 180 as illustrated in FIG. 12. The pump engine 100 may then be assembled to a container as desired. In addition, a pump head may be attached to the pump engine 100 such that fluid or product delivered through the pump engine 100 may exit the pump head upon actuation of the pump engine 100.

A pump engine 100 according to embodiments of the invention may include a precompression force which may improve the strength or quality of spray delivered from the pump engine 100. The stem 140 may be molded with an integral precompression spring 145 such that when actuated, the precompression spring 145 of the stem 140 is compressed to provide the precompression force on the fluid or product being pumped through the pump engine 100.

Figure 13:
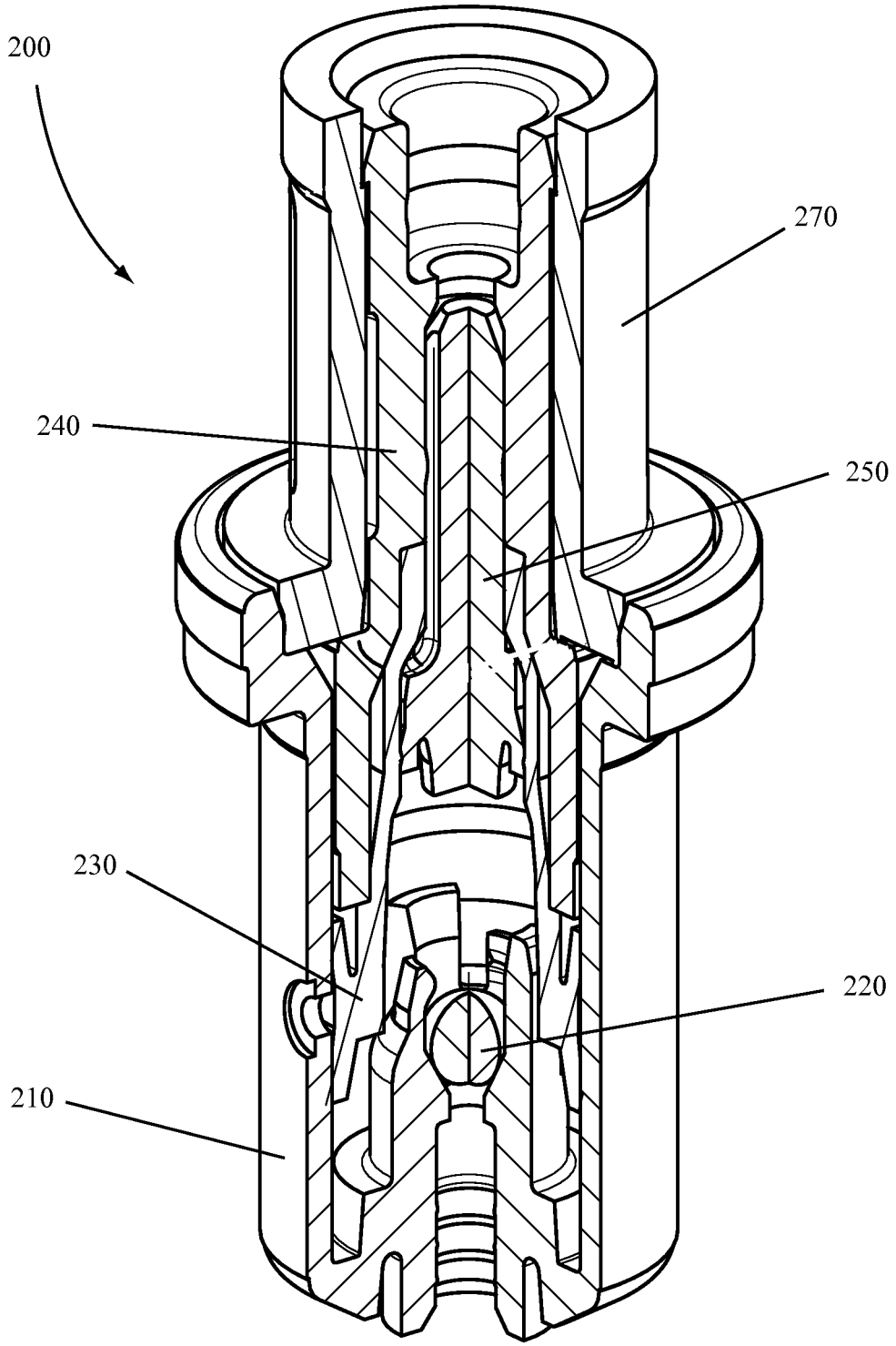
FIG. 13 illustrates a cut-away view of a pump engine according to various embodiments of the invention.

An alternative embodiment of a pump engine 200 according to various embodiments of the invention is illustrated in FIG. 13. The pump engine 200 may include an accumulator 210, a valve element 220, a piston 230, a stem 240, a plug 250, and a spring element 270. According to various embodiments of the invention, the components of a pump engine 200 may be made of a plastic material, of a resin material, or any other desired material. In certain embodiments, the components of a pump engine 200 are made of plastic such that the entire pump engine 200 may be recycled.

Figure 14:
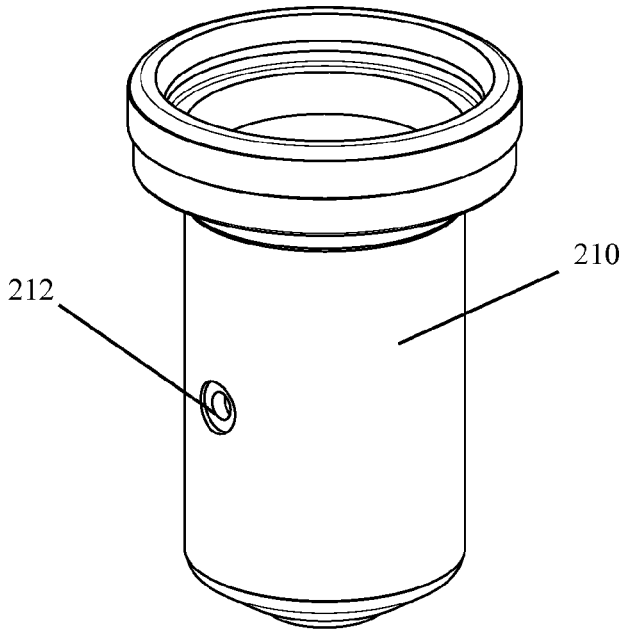
FIG. 14 illustrates an accumulator for a pump engine according to various embodiments of the invention.
Figure 15:
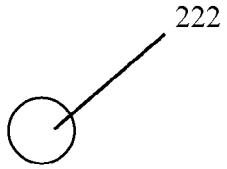
FIG. 15 illustrates a ball for a valve in a pump engine according to various embodiments of the invention.
Figure 16:
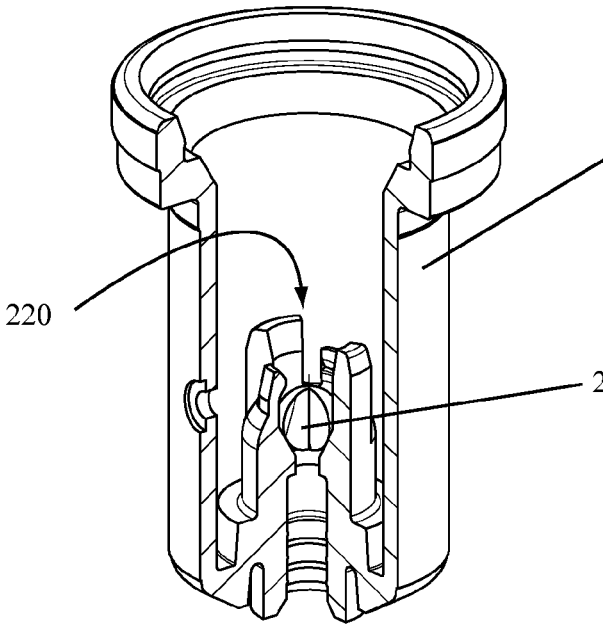
FIG. 16 illustrates a cut-away view of an accumulator for a pump engine according to various embodiments of the invention.
Figure 17:
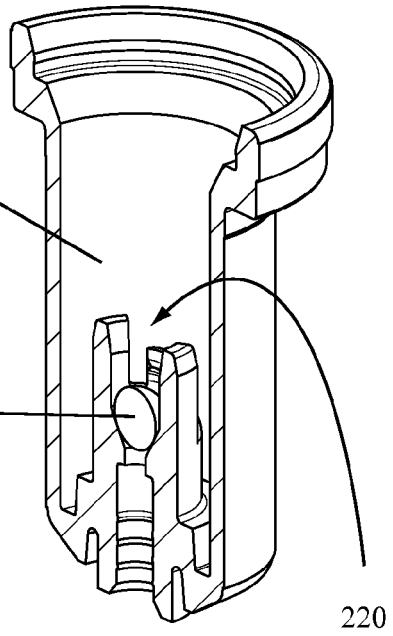
FIG. 17 illustrates a cut-away view of an accumulator for a pump engine according to various embodiments of the invention.

An accumulator 210 according to various embodiments of the invention is illustrated in FIG. 14. Cut-away and cross-sectional views of an accumulator 210 according to embodiments of the invention are further illustrated in FIGS. 16 and 17. According to embodiments of the invention, an accumulator 210 may include one or more vent holes 212 as illustrated in FIG. 14. An accumulator 210 may also include a valve element 220. According to some embodiments of the invention, a valve element 220 may include a ball valve system as illustrated in FIGS. 16 and 17. A ball 222, as illustrated in FIG. 15, may be swedged or otherwise contained over a fluid or product intake hole in an accumulator 210. The ball 222 may be any of a plastic ball, glass ball, or metal ball as desired. The ball 222 may also be made of any other desired material. According to other embodiments of the invention, alternative valve elements 220 may be used or configured with a pump engine 200. For example, a valve element 120 similar to that illustrated in FIG. 1 could be used with embodiments of the invention.

Figure 30:
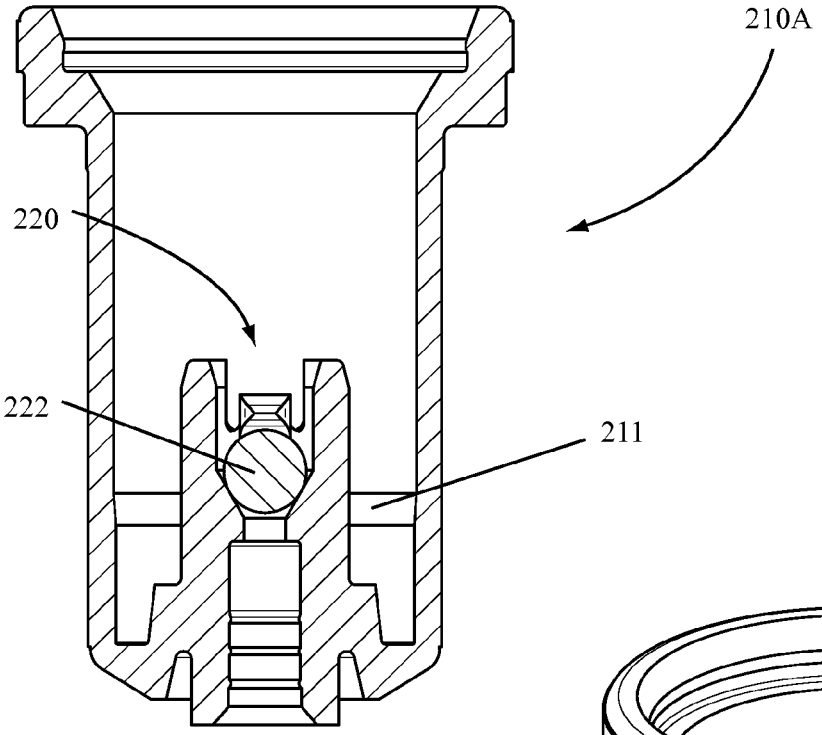
FIG. 30 illustrates a cut-away view of an accumulator for a pump engine according to various embodiments of the invention.
Figure 31:
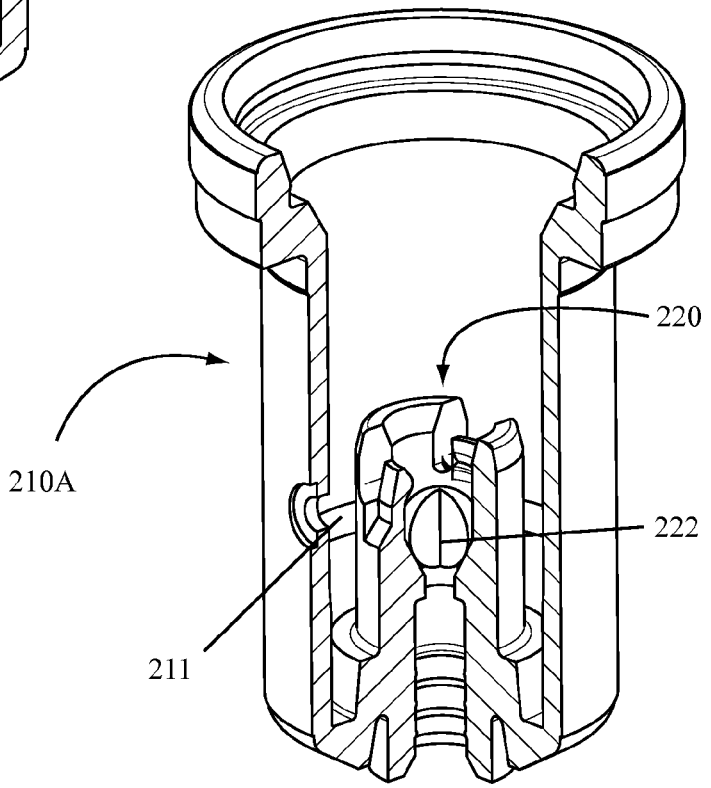
FIG. 31 illustrates a cut-away view of an accumulator for a pump engine according to various embodiments of the invention.
Figure 32:
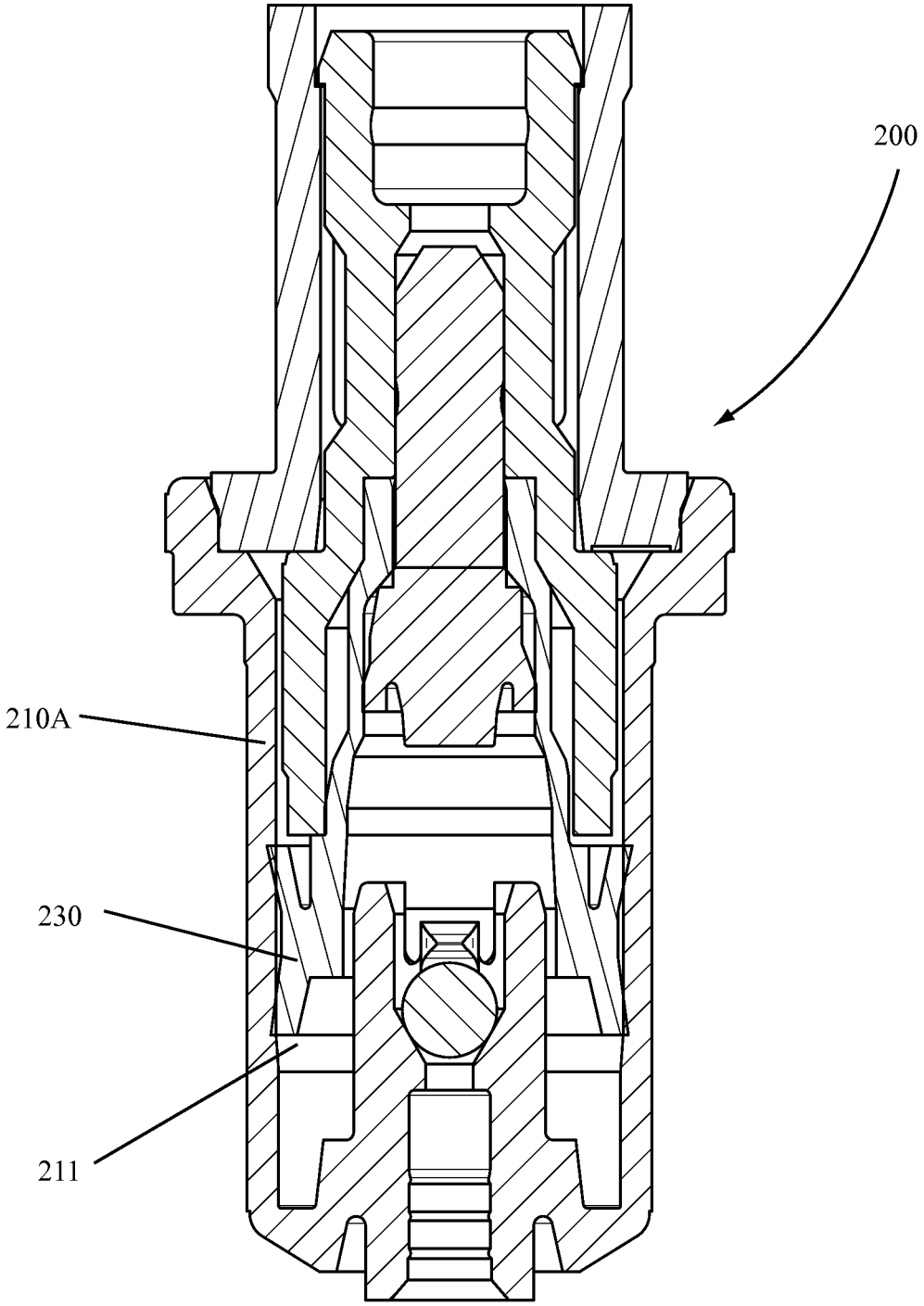
FIG. 32 illustrates a cut-away view of a pump engine according to various embodiments of the invention.

An alternative embodiment of an accumulator 210A according to various embodiments of the invention is illustrated in FIGS. 30 and 31. As illustrated, the alternate accumulator 210A may include all of the features of the accumulator 210 illustrated in FIGS. 16 and 17. In addition, accumulator 210A may include one or more steps 211 located on an interior wall within the accumulator 210A such that the circumference of the opening within the accumulator 210A narrows from the top opening of the accumulator 210A to the bottom near a valve element 220. The interior circumference may be customized through the use of one or more steps 211 such that a piston 230 may rest in a portion of the accumulator 210A having a first circumference and be pushed into a portion of the accumulator 210A having a second, narrower circumference during actuation. For example, as illustrated in FIG. 32, a piston 230 rests above a step 211 in an accumulator 210A in a pump engine 200 when at rest. Upon actuation, the piston 230 moves over the step 211, which may further stress the piston 230 and improve the interference between the piston 230 and the wall of the accumulator 210A. The improved or increased interference may improve the seal between the piston 230 and the accumulator 210A wall. Upon release, the piston 230 may return to a position above the step 211 as illustrated.

According to certain embodiments of the invention, a step 211 may be included in an accumulator 210A in order to improve the life of the pump 200 and the seal between the piston 230 and accumulator 210A wall. The reduced force applied to the piston 230 at rest by the larger circumference wall of the accumulator 210A may improve the life of the piston 230 because the piston 230 is only stressed as the piston 230 passes over a step 211 and the forces acting on the piston 230 and accumulator 210A wall are increased in the narrower circumference area of the accumulator 210A. Upon returning to a rest position, those forces are reduced and less stress is placed on the piston 230 which may result in a longer piston 230 life.

Figure 18:
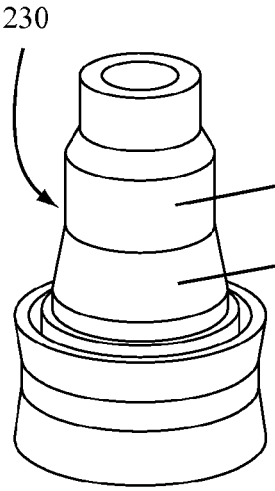
FIG. 18 illustrates a piston for a pump engine according to various embodiments of the invention.
Figure 19:
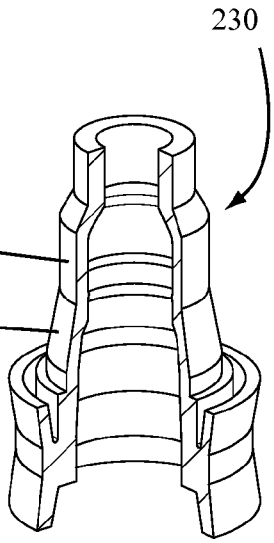
FIG. 19 illustrates a cut-away view of a piston for a pump engine according to various embodiments of the invention.
Figure 20:
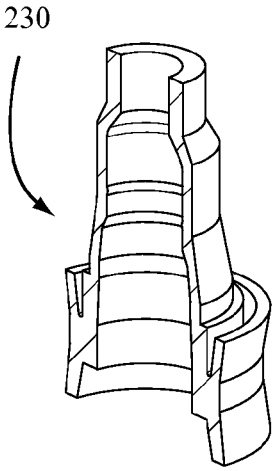
FIG. 20 illustrates a cut-away view of a piston for a pump engine according to various embodiments of the invention.

A piston 230 according to various embodiments of the invention is illustrated in FIGS. 18 through 20. According to embodiments of the invention, a piston 230 may be configured as desired. For example, a piston 230 may include a stepped wall having an inwardly sloping wall portion 231A and a vertical wall portion 231B as illustrated. Other wall configurations may also be used as desired and such configurations may be altered to adjust the force required to actuate the piston 230 or the feel of the actuation during actuation of a pump engine. In some embodiments of the invention, the piston 230 may be made of a flexible material such that the walls of the piston 230 may flex when sufficient force is applied to the walls of the piston 230. According to some embodiments of the invention, a piston 230 may also contain ridges or other features that may mate with, seal with, or otherwise contact a plug 250, a stem 240, or both.

Figure 33:
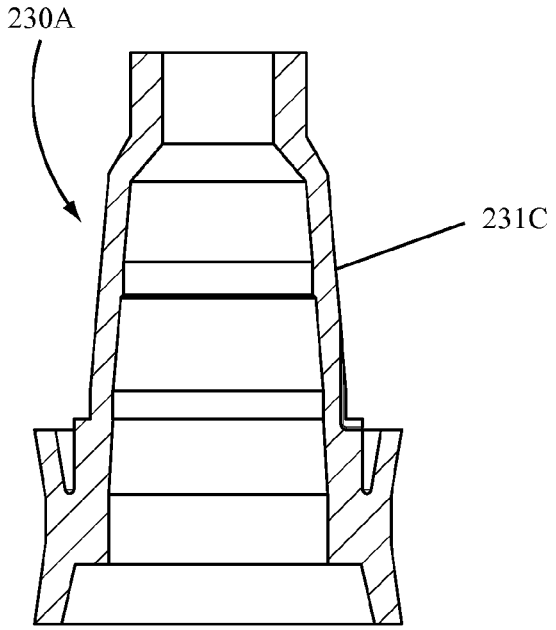
FIG. 33 illustrates a cut-away view of a piston for a pump engine according to various embodiments of the invention.
Figure 34:
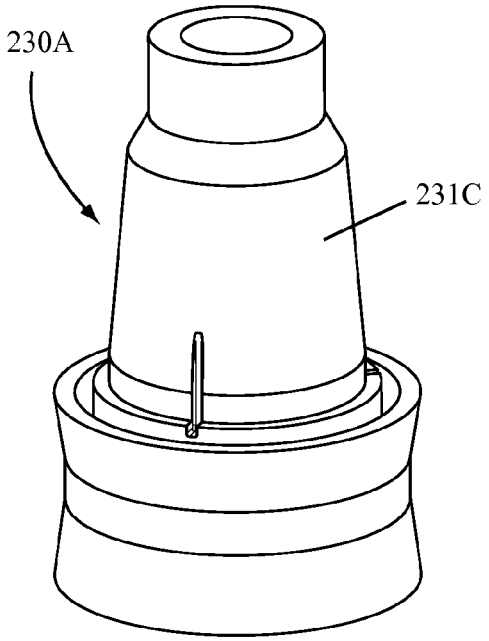
FIG. 34 illustrates a piston for a pump engine according to various embodiments of the invention.
Figure 35:
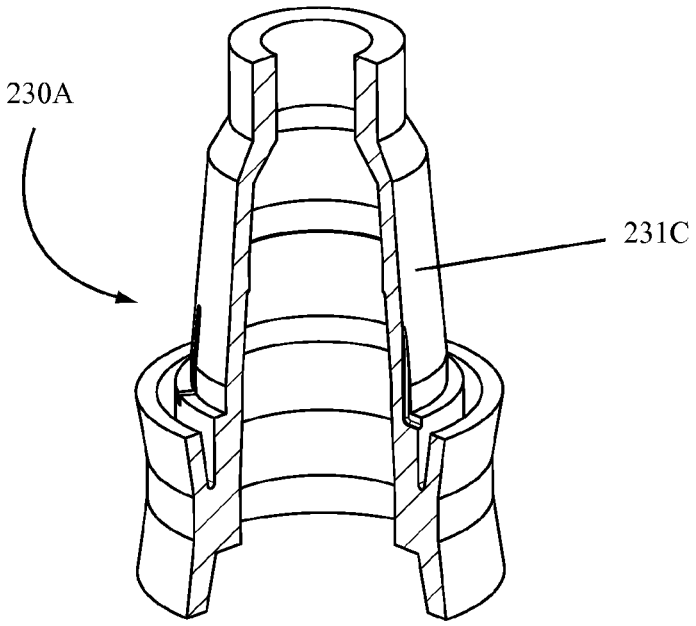
FIG. 35 illustrates a cut-away view of a piston for a pump engine according to various embodiments of the invention.

A piston 230A according to other embodiments of the invention is illustrated in FIGS. 33 through 35. As with the piston 230 illustrated in FIGS. 18 through 20, a piston 230A may be configured as desired. However, unlike piston 230, a piston 230A may include a straight wall portion 231C. The use of a straight wall portion 231C as illustrated in FIGS. 33 through 35 for a piston 230A may reduce the force needed to actuate the piston 230A because the straight wall portion 231C facilitates the bending of the piston 230A wall more than the configuration illustrated in FIGS. 18 through 20. The ability to bend more easily may reduce the force required to actuate the piston 230A.

According to certain embodiments of the invention, as a pump engine 200 is actuated, product contained within an interior space of the accumulator is compressed by the piston 230 and that compression applies a force against the piston 230 walls causing the piston 230 walls to bulge. A space between the piston 230 walls and the stem 240 may allow the piston 230 walls to move or bulge. As the walls bulge, an opening between the piston 230 walls and a plug 250 is created, allowing product to flow by the plug 250 and exit the pump engine 200. Configuration of the shape, thickness, size, and material of the piston 230 walls can vary the forces necessary to cause the unseating of the piston 230 and the plug 250 and thus dictate a force at which product will begin to flow or a precompression force at which product can escape and interior of the accumulator.

Figure 21:
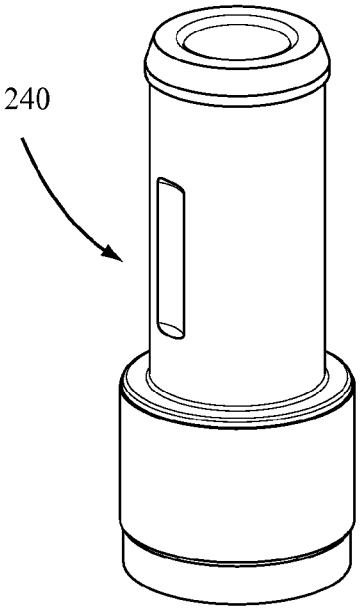
FIG. 21 illustrates a stem for a pump engine according to various embodiments of the invention.

A stem 240 according to various embodiments of the invention is illustrated in FIG. 21. The stem 240 may be configured as desired and made from any desired material.

Figure 22:
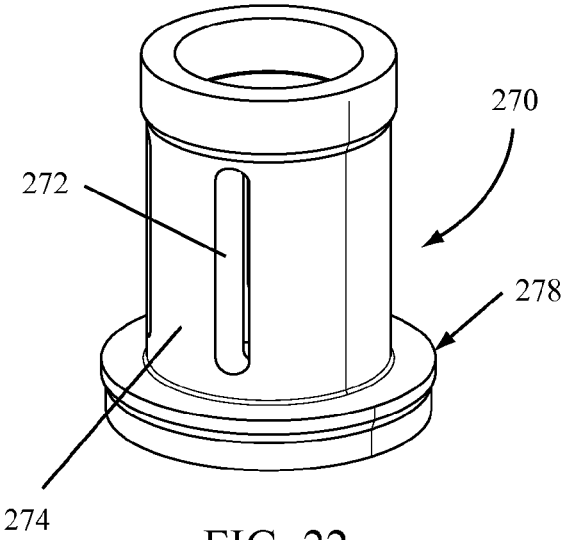
FIG. 22 illustrates a spring for a pump engine according to various embodiments of the invention.
Figure 23:
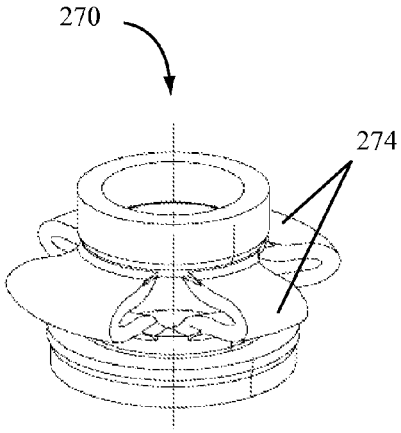
FIG. 23 illustrates a spring for a pump engine according to various embodiments of the invention wherein the spring has been stressed or actuated.
Figure 24:
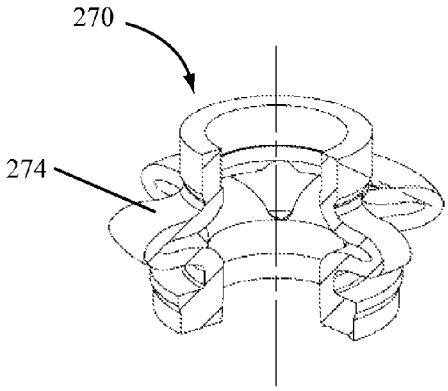
FIG. 24 illustrates a cut-away view of spring for a pump engine according to various embodiments of the invention wherein the spring has been stressed or actuated.
Figure 25:
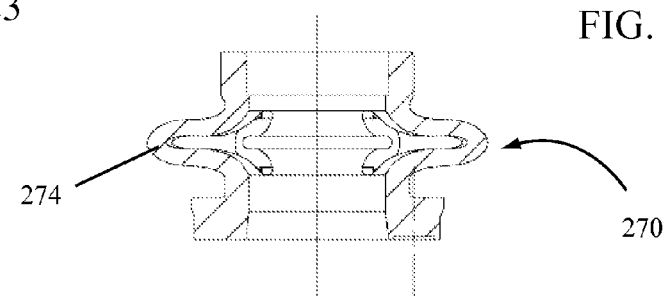
FIG. 25 illustrates a cross-sectional view of a spring for a pump engine according to various embodiments of the invention wherein the spring has been stressed or actuated.

A spring element 270 according to various embodiments of the invention is illustrated in FIGS. 22 through 25. As illustrated in FIG. 22, a spring element 270 may include one or more spring slots 272. The spring slots 272 may be openings in the wall of the spring element 270 and the portions of the spring element 270 walls between the spring slots 272 may define spring arms 274. As force is applied to the top of the spring element 270, the spring arms 274 may flex outward as illustrated in FIGS. 23 through 25, allowing the spring element 270 to compress. The spring element 270 may also include one or more fitments 278 for connecting the spring element 270 to an accumulator 210 as illustrated in FIG. 13.

As illustrated in FIGS. 23 through 25, a spring element 270 may be compressed. During compression, the spring arms 274 may flex outwards due to the presence of the one or more spring slots 272 in the wall of the spring element 270. When a compressive force is released, the spring arms 274 may return to the normal position, thereby extending and applying a spring force to the pump following actuation of a pump engine 200.

According to various embodiments of the invention, a spring element 270 may be made of any desired material and the wall thickness or spring arm 274 thickness may be varied to supply a desired force for actuation and return of the pump engine 200 to a non-actuated state following removal of force on the spring element 270. In some embodiments of the invention, the spring element 270 may be made of a material which can be recycled. For example, a spring element 270 may be made of plastic or other recyclable resin material.

Figure 26:
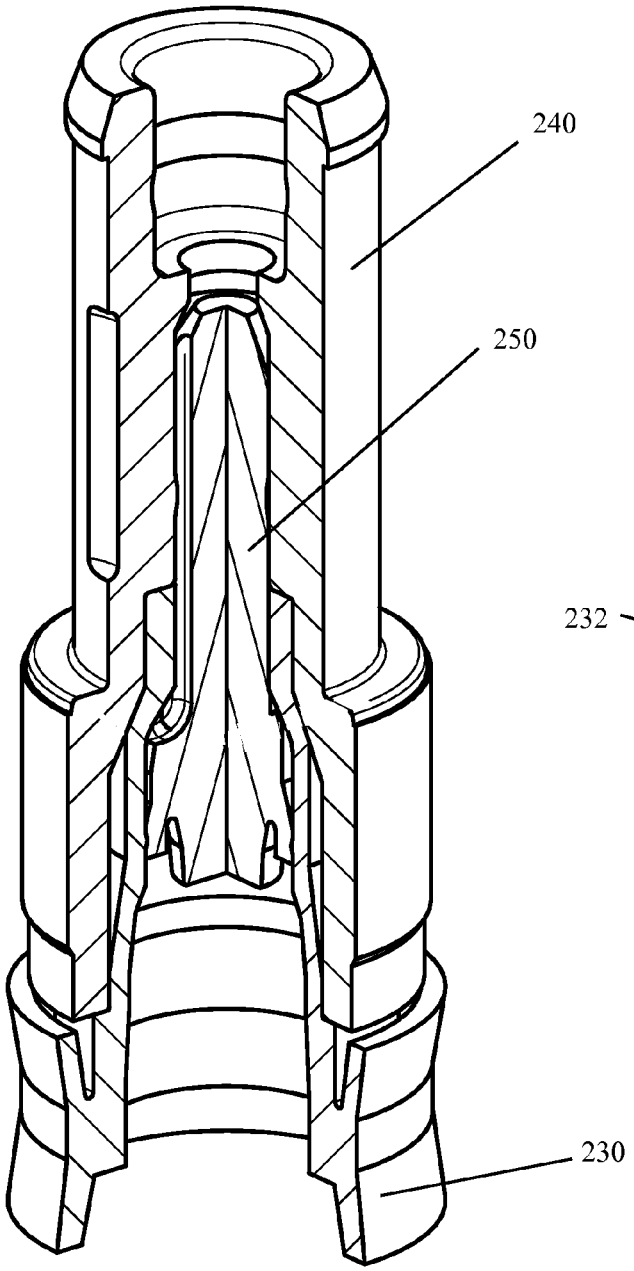
FIG. 26 illustrates a cut-away view of a piston sub-assembly for a pump engine according to various embodiments of the invention.
Figure 27:
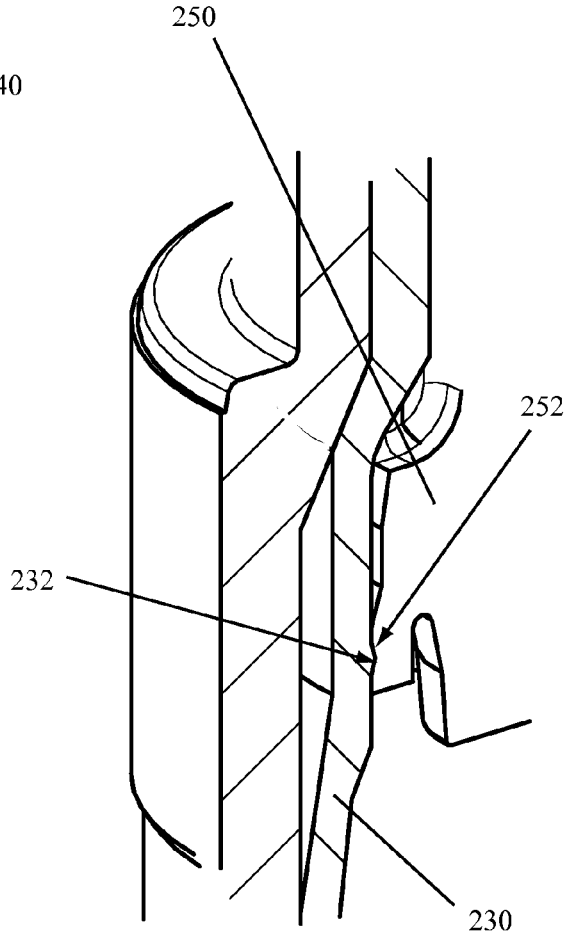
FIG. 27 illustrates a close-up cut-away view of the plug and piston intersection illustrated in FIG. 26.

A piston sub-assembly of the pump engine 200 is illustrated in FIG. 26. As illustrated, a piston 230 may fit into an interior space of the stem 240. A plug 250 may be positioned in a portion of the interior space of the piston 230 and the stem 240. The plug 250 may mate with or contact the piston 230. As illustrated in FIG. 27, the plug 250 and piston 230 may contact or mate with each other at a plug point 252 and piston point 232. The plug point 252 and piston point 232 may be configured to prevent fluid or product flow past the plug 250 when no forces are acting on the piston 230. As a pump engine 200 is actuated, product or fluid contained in an interior portion of the piston 230 may build up pressure and apply a force to the interior piston 230 wall. At a particular point, the force applied to the piston 230 wall may overcome the connection between the piston point 232 and the plug point 252 such that fluid or product may pass by the plug 250 and out of the pump engine 200. In this manner, a precompression force may be built up upon actuation of the pump engine 200.

Figure 36:
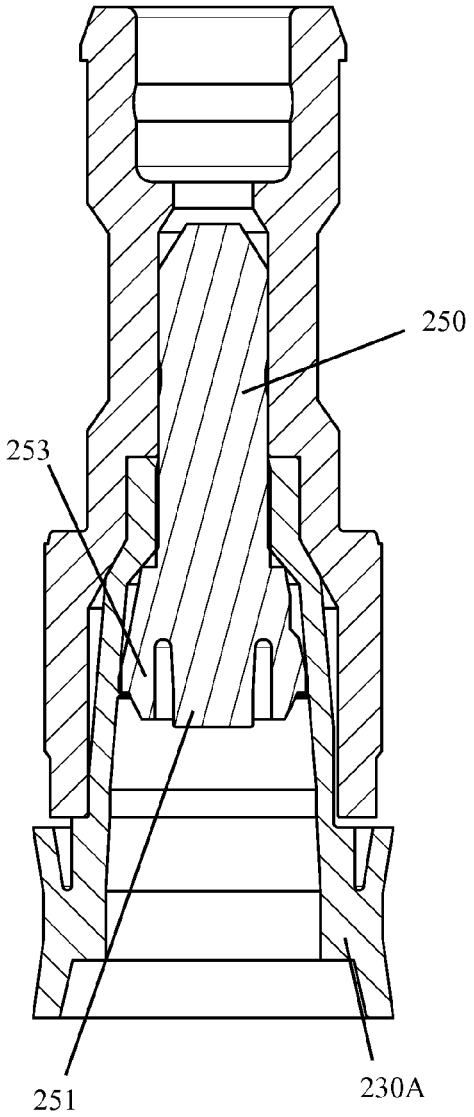
FIG. 36 illustrates a cut-away view of a piston sub-assembly for a pump engine according to various embodiments of the invention.

A piston sub-assembly of a pump engine 200 according to other embodiments of the invention is illustrated in FIG. 36. As illustrated, the piston sub-assembly may include the same features as that illustrated in FIG. 26 and may act in a similar manner. However, the piston sub-assembly illustrated in FIG. 36 may include a piston 230A having a straight side wall portion as illustrated in FIGS. 33 through 35.

Figure 37:
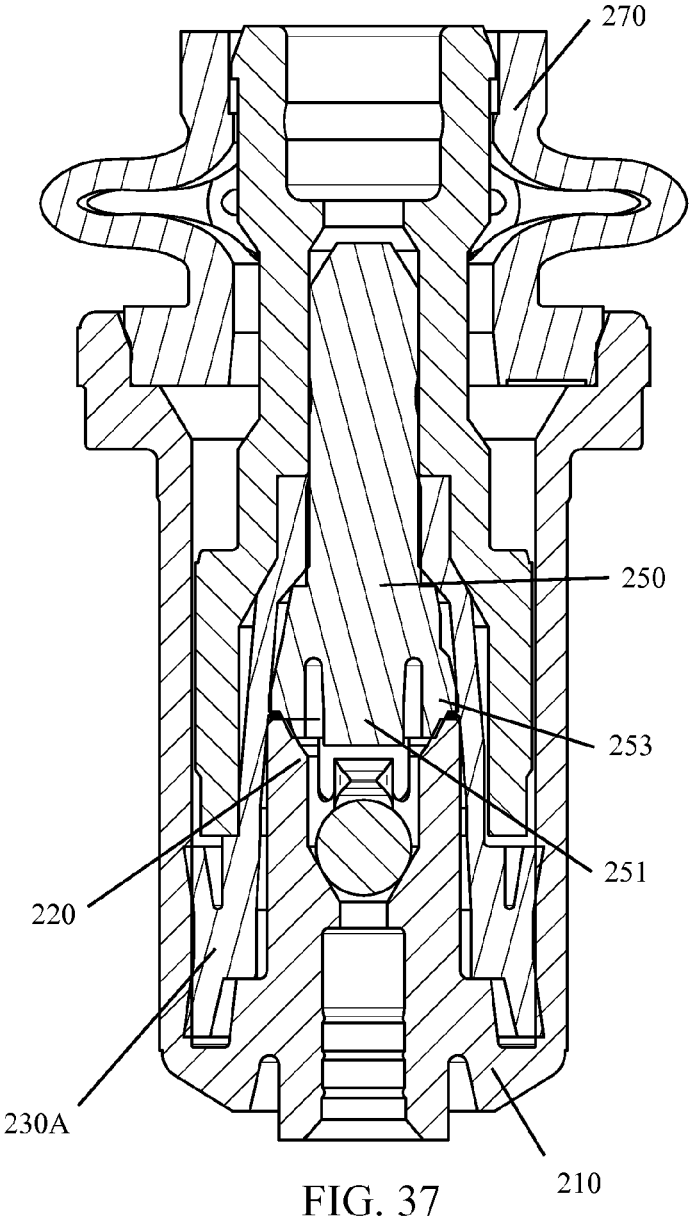
FIG. 37 illustrates a cross-sectional view of an actuated pump engine according to various embodiments of the invention.

In addition, a plug 250 may include an alternate configuration as desired and as illustrated in FIG. 36. According to certain embodiments of the invention, a plug 250 may include a top portion and a bottom portion wherein the bottom portion is seated facing a valve 220 when assembled in a pump engine 200. The bottom portion of the plug 250 may include an annular projection 251 and one or more exterior seal walls 253. A plug point 252 may be configured on an exterior portion of the one or more exterior seal walls 253 to mate with a piston point 232. A space between the annular projection 251 and the one or more exterior seal walls 253 may allow the one or more exterior seal walls 253 to flex towards the annular projection 251 if sufficient force is applied to the one or more exterior seal walls 253. For example, an actuated pump engine 200 is illustrated in FIG. 37. Upon full actuation, the one or more exterior seal walls 253 of the plug 250 contact a portion of the valve 220 and are forced inward towards the annular projection 251. This movement forces the opening of a path between the plug 250 and piston 230A and may assist with the evacuation of air from the pump during priming.

According to embodiments of the invention, a precompression force for a pump engine 200 may be controlled or altered by varying the thickness of the piston 230 wall. In other embodiments, the precompression force may be altered by selecting the material for the piston 230. In still other embodiments, the piston 230 may be configured, shaped, or made of particular materials to alter the forces required to break the seal between a plug 250 and piston 230 in a pump engine 200. For example, a piston 230 having a stepped wall configuration as illustrated in FIGS. 18 through 20 may be used or a piston 230A having a straight wall configuration as illustrated in FIGS. 33 through 35 may be used.

Figure 28:
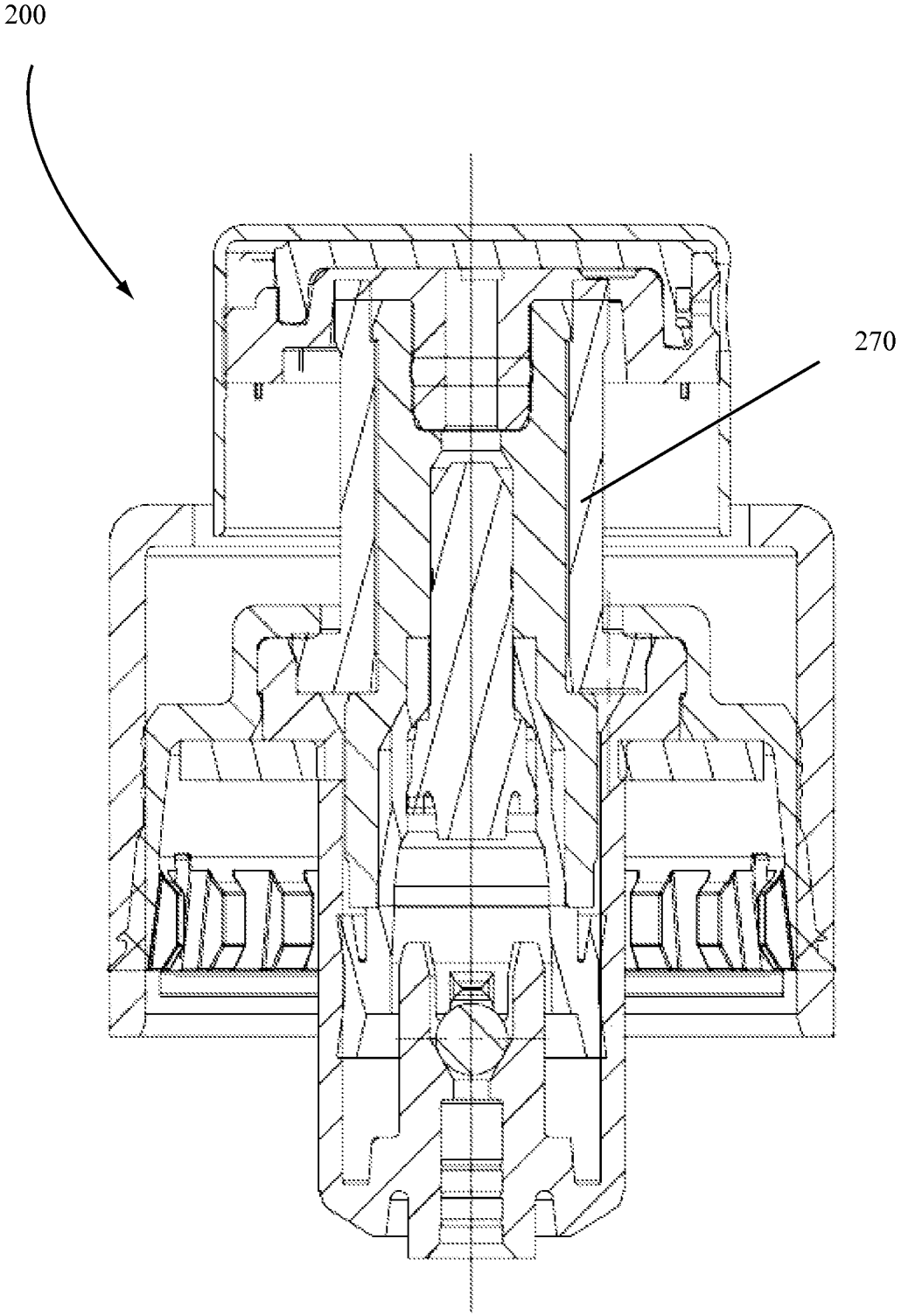
FIG. 28 illustrates a cross-sectional view of a pump engine and actuator according to various embodiments of the invention.
Figure 29:
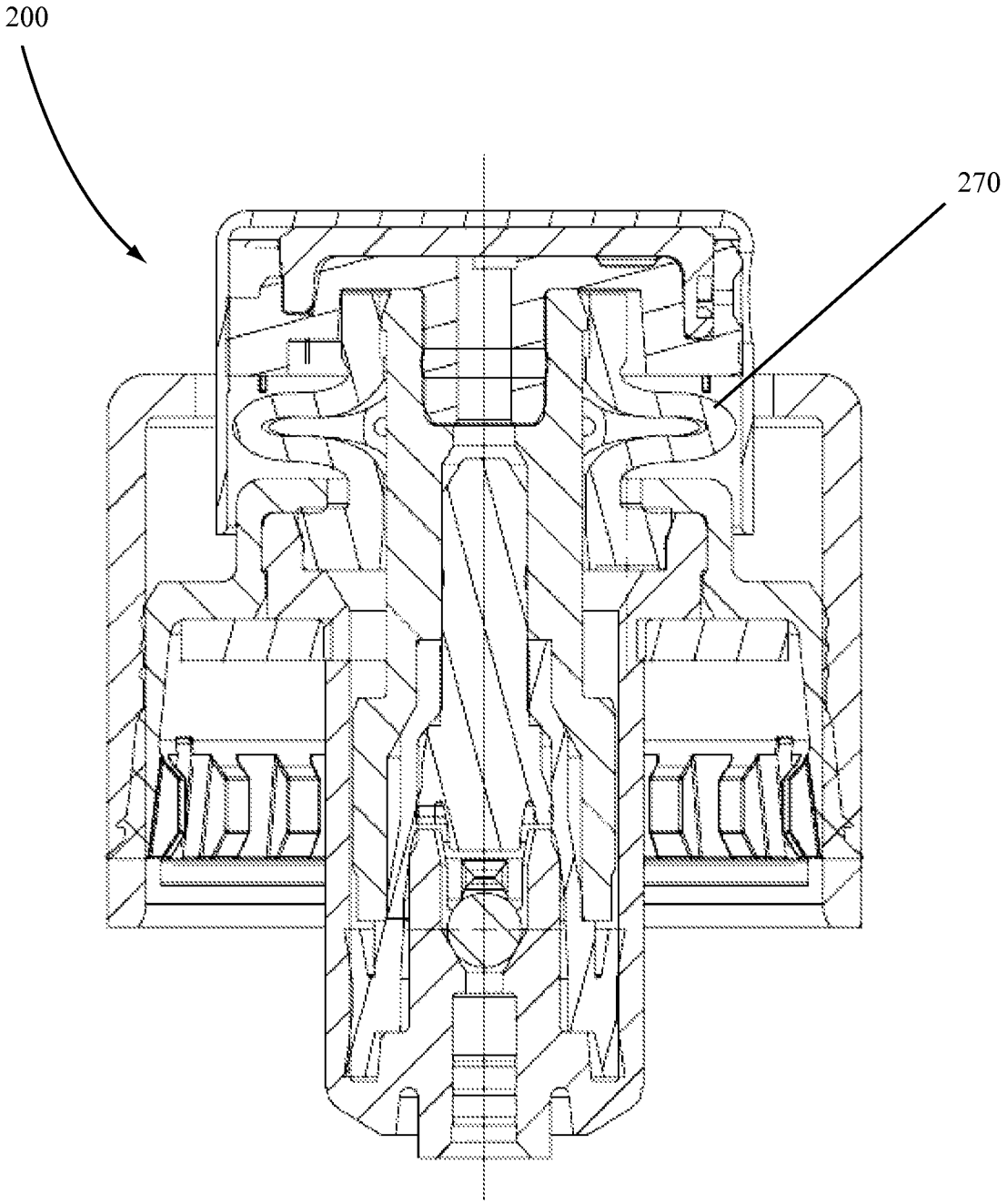
FIG. 29 illustrates a cross-sectional view of the pump engine and actuator illustrated in FIG. 28 wherein the pump is in an actuated state.

A pump engine 200 assembled with a pump head and container or bottle attachment is illustrated in FIGS. 28 and 29. As illustrated in FIG. 28, the pump engine 200 is in a non-actuated state and the spring element 270 is not stressed. In FIG. 29, the pump engine 200 is illustrated in an actuated state and the spring element 270 is stressed such that the spring arms 274 are compressed and flexed outwards. Upon release of the actuation force illustrated in FIG. 29, the spring element 270 will relax and return the pump engine 200 to the state illustrated in FIG. 28.

According to various embodiments of the invention, a pump engine 100 or a pump engine 200 may be assembled with a pump head and attached to a container or bottle containing a product, such as a perfume, lotion, fluid, or other product. The pump engine may be used to pump or deliver the product from the container or bottle to a user upon actuation of the pump engine.

Having thus described certain particular embodiments of the invention, it is understood that the invention defined by the appended claims is not to be limited by particular details set forth in the above description, as many apparent variations thereof are contemplated. Rather, the invention is limited only be the appended claims, which include within their scope all equivalent devices or methods which operate according to the principles of the invention as described.

What is claimed is:

1. A pump assembly, comprising:

a container;

a pump engine attached to the container, the pump engine comprising:

an accumulator having a product intake hole at one end;

a ball swedged adjacent the product intake hole to provide a valve element for the pump engine;

a stem moveably mounted in an interior portion of the accumulator;

a piston mounted in an end of the stem between the stem and the product intake hole, the piston having a piston point about an interior circumference of the piston;

a plug mounted in an interior portion of the piston and extending into an interior portion of the stem, the plug having a plug point adjacent the piston point, wherein the plug point and piston point form a seal;

a space between an exterior wall of the piston and an interior wall of the stem, wherein the space allows the piston to flex during actuation of the pump assembly, breaking the seal between the piston point and the plug point; and a spring element mounted about an exterior of the stem and on a top portion of the accumulator;

a pump head assembled with the pump engine.

2. The pump assembly of claim 1, wherein the piston comprises a stepped wall.

3. The pump assembly of claim 1, wherein the piston comprises a straight wall.

4. The pump assembly of claim 1, further comprising a step on an interior wall of the accumulator, wherein a circumference of the interior wall of the accumulator between the step and the product intake hole is narrower than the circumference above the step.

5. The pump assembly of claim 1, wherein the plug further comprises:

an annular projection in a bottom portion of the plug;

at least one exterior seal wall adjacent the annular projection, wherein the plug point is on an exterior surface of the at least one exterior seal wall; and a space between the annular projection and the at least one exterior seal wall, wherein the at least one exterior seal wall is configured to flex inward towards the annular projection during actuation of the pump assembly.

6. The pump assembly of claim 1, wherein the space further comprises a space adjacent to the piston point between an exterior wall of the piston and an interior wall of the stem.

7. The pump assembly of claim 1, wherein the spring element further comprises a plurality of spring arms.

8. The pump assembly of claim 1, wherein the spring element further comprises:

a wall formed of a flexible material; and at least one spring slot in the wall.

* * * * *